United States Patent [19]

Heimbrand et al.

[11] 3,941,173

[45] Mar. 2, 1976

[54] APPARATUS FOR MACHINING THE EDGES OF PANELS, ESPECIALLY PANELS OF WOOD MATERIAL HAVING HARD GLUE LAYERS THEREON

[75] Inventors: Eberhard Heimbrand, Horb; Peter Bok, Glatt, both of Germany

[73] Assignee: Ledermann & Co., Germany

[22] Filed: Mar. 27, 1974

[21] Appl. No.: 455,289

[30] Foreign Application Priority Data

Mar. 29, 1973 Germany ..... 2315719

[52] U.S. Cl. ..... 144/114 R; 90/11 A; 144/90 R; 144/118; 144/134 A; 144/218

[51] Int. Cl.[2] ..... B27C 1/00

[58] Field of Search... 90/11 A; 144/2 R, 90, 114 R, 144/118, 134 A, 218, 134 R; 83/425.4, 368

[56] References Cited

UNITED STATES PATENTS

| | | | |
|---|---|---|---|
| 984,407 | 2/1911 | Wolvin | 144/134 A |
| 1,186,048 | 6/1916 | Solem | 144/90 R |
| 1,213,888 | 1/1917 | Lane | 144/134 A |
| 2,816,581 | 12/1957 | Traben | 83/425.4 |
| 3,260,142 | 7/1966 | Nitchie et al. | 83/368 X |
| 3,838,722 | 10/1974 | Downing | 144/118 |

*Primary Examiner*—Donald R. Schran
*Assistant Examiner*—W. D. Bray
*Attorney, Agent, or Firm*—Walter Becker

[57] ABSTRACT

A method and apparatus for edge machining panels, especially panels having a hard glue layer thereon. Rotary edge cutting tools are presented to the panel edge to be cut. The tools having axially overlapping cutters thereon. There is moving of the tools by equal amounts in opposite directions during rotation of the tools to compensate for wear of the tools caused by the hard glue layer in the panels.

9 Claims, 4 Drawing Figures

9
10
11
12
14
15
16
17
18
19
20
21
22
23
24
25
26
27
28
29
30
31
32
33
34
35
36
37
38
8
140
150
160
220
230
240
250
260
340

APPARATUS FOR MACHINING THE EDGES OF PANELS, ESPECIALLY PANELS OF WOOD MATERIAL HAVING HARD GLUE LAYERS THEREON

The present invention relates to a device for machining, especially milling the edges of workpiece plates which cause different tool wear over their thickness, such as plywood plates covered with a synthetic layer, with a rotary tool which is arranged on a tool spindle and during the working operation cuts around the circumference while said rotary tool is adapted by means of an adjusting device including a slide bearing means is axially displaceable into different working positions and in the respective working position is by means of a securing device secured substantially in a play-free manner relative to the tool spindle.

In particular when machining plywood plates covered by synthetic material for furniture, a very clean and depression-free cutting edge is desired. The tools for machining the plate edges are, however, due to differently hard zones of such workpiece edges namely harder synthetic material layers, glue areas or connecting areas differently worn so that in the corresponding tool zones depressions occur which in an increasing manner affect a uniform cut so that after a short cutting time, a tool change or at least a change in the position of the tool becomes necessary. To this end, with the heretofore known device, a stopping of the tool spindle, i.e., of the machining operation is necessary which results in considerable idling times and costs, particularly when the device forms a machining station in a machining train. Furthermore, in this way only a stepwise change in the machining is possible so that nonuniform edge qualities on the workpiece plates result.

It is, therefore, an object of the present invention to provide a device of the above mentioned general type which while being designed in a simple manner and which while functioning safely will permit a change in the position of the tool during the machining operation. These and other objects and advantages of the invention will appear more clearly from the following specification in connection with the accompanying drawings, in which.

Figure 1:
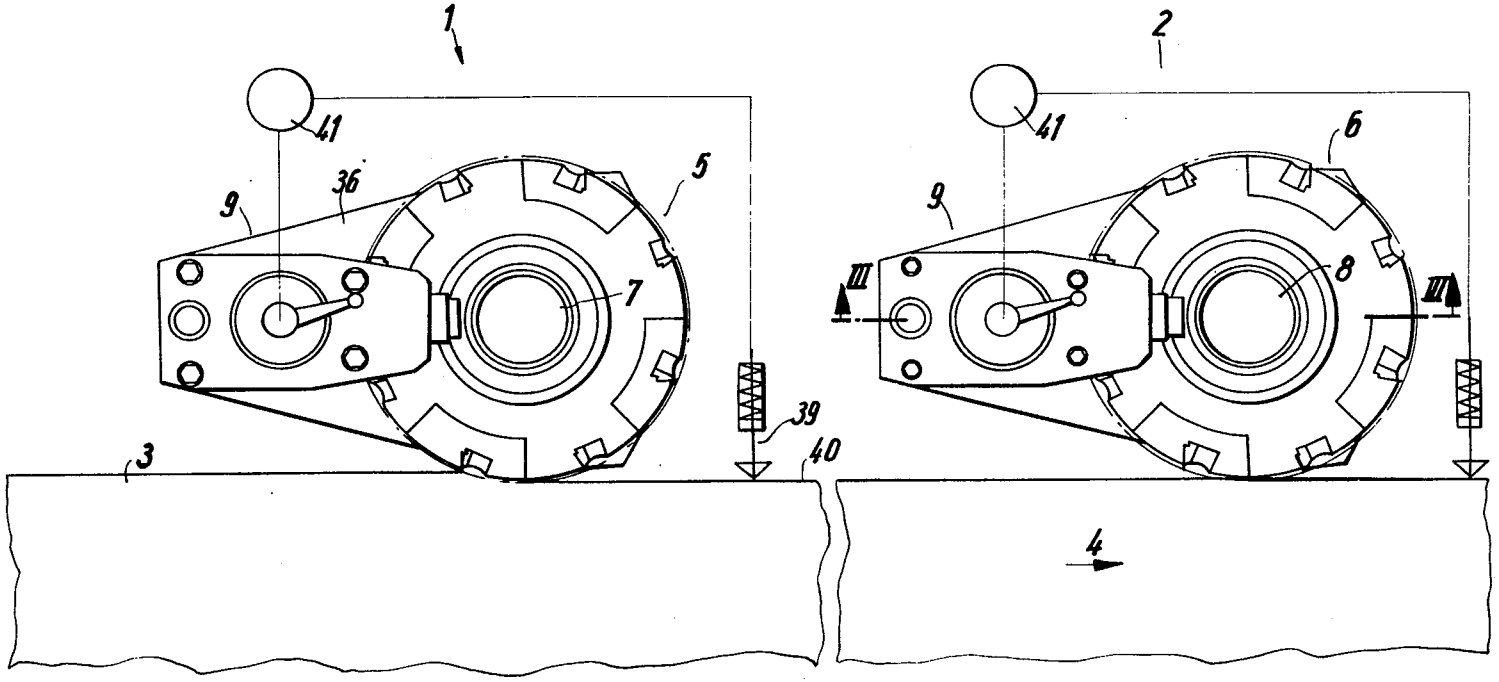
FIG. 1 shows a cutout of an axial view of the device according to the invention.

The device according to the present invention is characterized primarily in that for adjusting the tool in working operation the securing device is formed directly by the approximately play-free slide bearing means for the tool which in each adjusting position is in working position, said tool being in adjusting engagement with a driving element of the adjusting device that is operable while the tool spindle is rotating. The tool may be formed by a single cutting element for instance a cutting plate axially displaceable on a cutter head or by the cutter head which is axially displaceable as an entity and which may for instance comprise a plurality of rigidly connected cutting elements. The arrangement according to the present invention makes it possible to adjust the tool axially during the machining operation and thus without interrupting the machining operation, and in conformity with the requirements, to change the effective cutting ranges until the cutting blades have worn over the entire length up to the admissible limit whereupon only a stopping of the device will be required for changing the tool.

A very simple design is obtained when the slide bearing means comprises at least a bearing sleeve supporting the tool which sleeve is radially and/or in rotary direction substantially play-free axially displaceably mounted on the tool spindle preferably on the cylindrical outer circumferential surface thereof so that a stable mounting is obtained which in spite of the always present displaceability of the tool will permit keeping said tool in working engagement. It is also possible in an advantageous manner so to design the adjusting device that only during the adjustment which means only for a brief period will be in engagement with the tool but otherwise will not be in engagement with the tool, i.e., will not be connected thereto while special means may be provided for securing the tool in its respective adjusted position. A particularly advantageous further development of the invention consists in that the tool comprises two axially and adjacently arranged individual tools which are preferably image symmetrically designed with regard to their dividing plane and which axially overlap with their working zones which face each other. These individual tools are in a counter moving direction drivingly connected to the adjusting device so that with such workpiece plates which have their greatest hardness at their surfaces it will be possible to move these tool zones of the two individual tools which are subjected to the greatest stresses completely out of working engagement by axially moving these individual tools away from each other, while the machining is started with the individual tools completely moved together.

In order to permit a fast tool exchange while the adjusting device is substantially stationarily arranged, the driving element is movable into a position in which it is out of engagement with the tool while a simple overall construction is obtained when the output member is pivotable about an axis which is parallel to the tool spindle and/or located in the axis of an adjusting spindle of the adjusting device.

The adjusting device may be manually operable while the tool spindle is rotating, in which instance a corresponding adjusting handle is provided for instance on the adjusting spindle. However, it is particularly advantageous when the adjusting device comprises a pulse emitter by means of which the axial adjustment of the tool is initiated automatically to conform with a measured value. The edge quality of the tool may be used as measured value. Also, expediently in the path of movement of the workpiece edge, there is located a measuring element. This element mechanically or in a contact-free manner feels or scans for instance the workpiece edge with regard to the roughness thereof. This actuates the adjusting device by means of the pulse emitter when the admissible limit of the edge quality has been obtained. As measuring value, it is also possible in a step-free manner or stepwise to employ a time factor so that the tool will be adjusted in conformity with the time. Furthermore, as measuring value also the feed stroke may be employed so that in conformity with the feed stroke a stepless or stepwise adjustment of the tool is effected in which instance particularly a step-free adjustment of the tool is expedient, which adjustment is a linear axial adjustment relative to the feed stroke. In the last mentioned two instances emperical test values form the basis for the operation. The economy obtainable by the design according to the invention is further improved by the fact that for operating the device according to the invention, no highly skilled personnel is required because the formalized knowledge of a program control may be fed into the adjusting device so that the operating personnal merely performs a checking and control function. The described tool spindle may be formed directly by the working or main spindle of a machine tool which will then be designed accordingly. For a setting of already present or completed machine tools, it is, however, expedient to form the tool spindle by a separate spindle which comprises the connecting elements for instance an inner thread located in its axle for connection to the working or main spindle of a machine while in particular when the adjusting device is located outside the tool spindle, the support for connection to a stationary part of the machine tool is arranged for instance on the front bearing housing for the working or main spindle. According to the invention, for instance in feed direction, there may be provided two or more serially arranged machine stations respectively equipped with at least one tool spindle. By means of the first machining station, a premilling of the workpiece edges is effected during which the major portion of the material to be machined off will be chipped off. In order to prevent a breaking off or tearing off of the layer of synthetic material, the cutting elements, knives, other cutting means or turnover plates of the two individual tools are arranged in a V-shaped manner relative to each other so that they exert a cutting pressure component directed to the central plane of the workpiece plate, while said component is directed in particular upon the layer of synthetic material. The cutting edges may, however, be also arranged axis parallel to the tool. After the coarse chipping, the next tooling spindle or the next milling unit carries out the finished machining while a very small cutting depth is selected and the cutting edges may be arranged in a V-shaped or axia parallel manner with regard to the tool. In this way the entire production line will work at high capacity and thereby assure high economy. The tools of the serially arranged milling units or tool spindles are expediently adjustable in the described manner.

The present invention furthermore comprises a method of carrying out a chip-removing operation, especially the milling of the edges of workpiece plates which over their thickness cause different wear of the tool. Such workpiece plates are for instance plywood plates covered with synthetic material, the workpiece edges of which are in their longitudinal direction machined by tools cutting around the circumference and with which the tool for limiting the different nonuniform wear is axially adjusted.

With a method of this type it is provided according to the invention that the tool during the rotating chip removing operation and engagement of the workpiece edge is axially adjusted and during the adjusting movement is secured relative to the axis of rotation. It is particularly expedient when two axially adjacent individual tools which overlap each other are axially adjusted symmetrically and simultaneously away from each other and/or toward each other so that always a uniform edge quality will be obtained over the entire thickness of the workpiece.

The position of the workpiece may according to the invention be so varied that after certain periods of use, emperical values or after the rated values exceeded, a new edge portion is employed which has not been worn off. For instance, edge lengths 1/10 mm of a continuously fed cutting length may correspond to predetermined machined meters of edge length.

Figure 2:
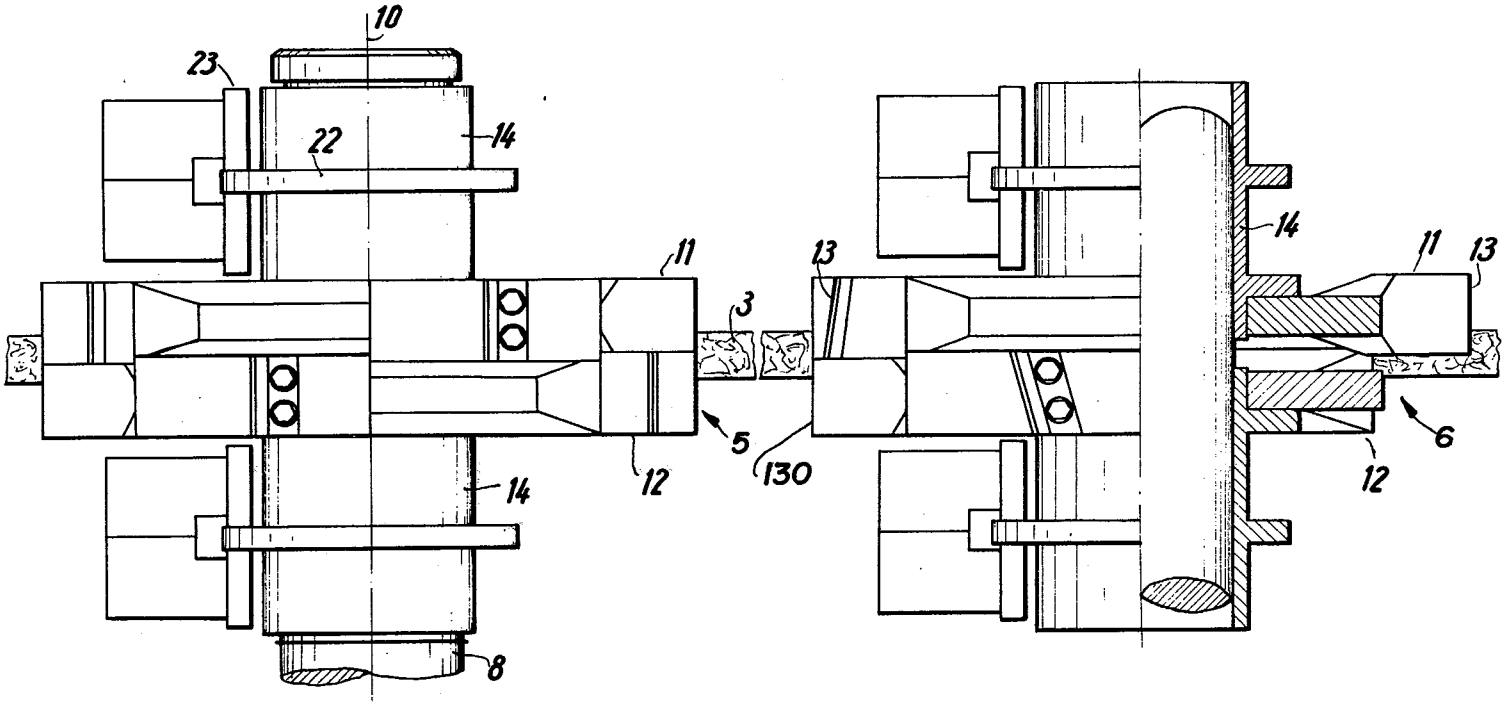
FIG. 2 represents a cutout of FIG. 1 partially in sectioned top view.

Referring now to the drawings which show two embodiments of the invention with the parts essential for the invention and in nearly actual size, the arrangement illustrated in FIGS. 1 and 2 comprises two milling units 1, 2 which in feeding direction indicated by the arrow 4 of the workpiece 3 are arranged one behind the other. Such workpiece 3 may for instance consist of a plywood plate which on both sides is covered by a layer of synthetic material. The two milling units 1, 2 are substantially of the same design and in the feeding direction indicated by arrow 4 are spaced from each other by such a great distance that in particular the second milling unit 2 is not influenced by the oscillating shocks or the like caused by the first milling unit 1. Each milling unit 1, 2 has a milling tool 5, 6 which cuts the periphery and which is arranged on a tool spindle 7, 8 and is adjustable by means of an adjusting device 9 in axial direction on the tool spindle 7, 8.

Figure 3:
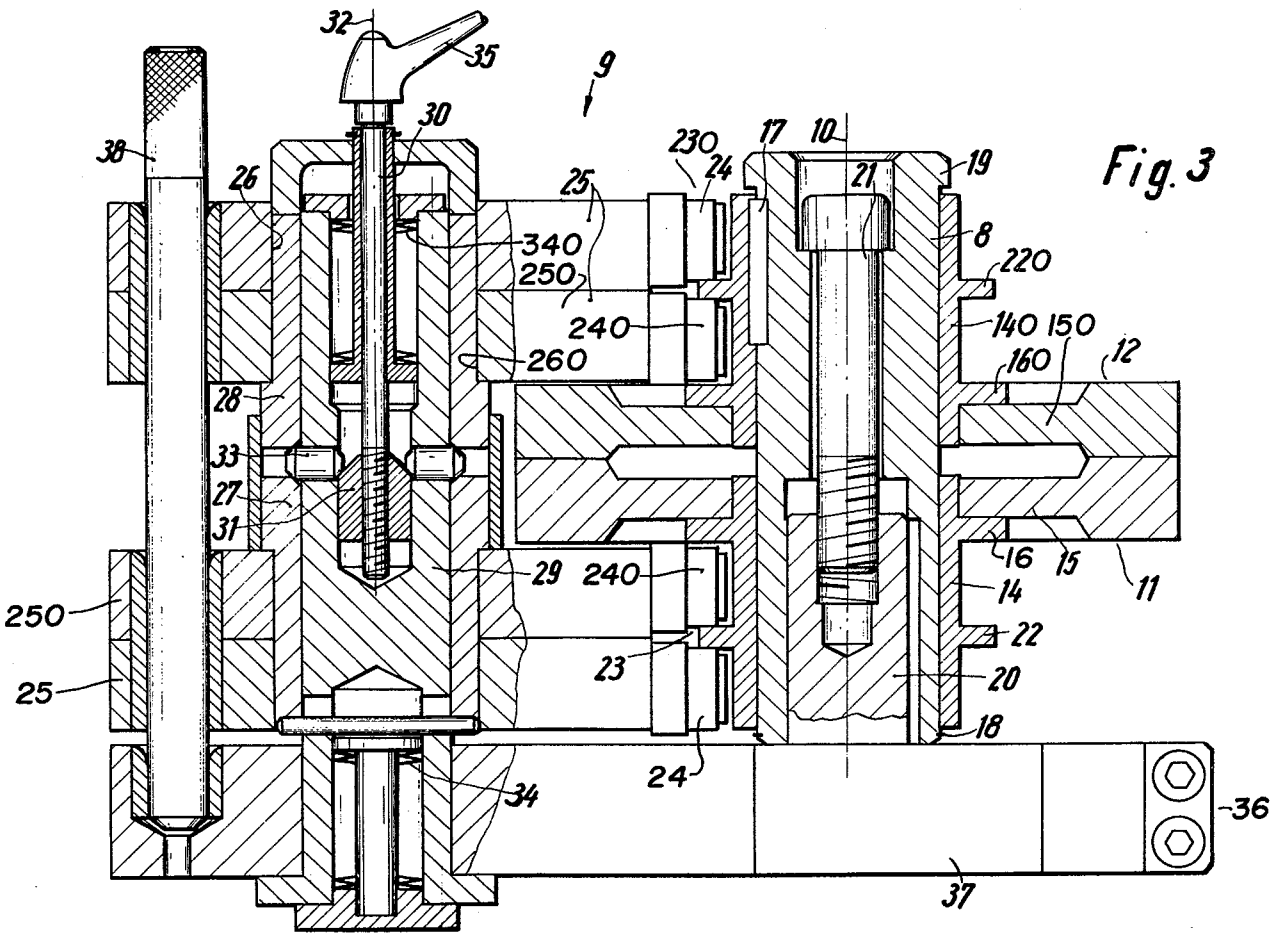
FIG. 3 represents a section taken along the line III—III of FIG. 1 but on a larger scale than that of FIG. 1.

As will be seen from FIGS. 1–3, each tool 5, 6 comprises two individual tools 11, 12 which in the direction of the spindle axis 10 are arranged adjacent to each other and the circumferential cutting edges 13, 130 which are formed by changeably inserted cutting plates overlapping each other in axial direction at those end faces which face each other. The cutting edges 13, 130 of the two individual tools 11, 12 are arranged in circumferential direction so as to define a gap therebetween and are located image symmetrically with regard to the dividing plane between the two individual tools 11, 12; the same are located in a V-shaped arrangement and defining therebetween an obtuse angle. Each individual tool 11, 12 is by means of a cutting blade carrier 15, 150 connected to one of two substantially identical sleeves 14, 140. The two individual tools 11, 12 engage those end faces of flanges 16, 160 of the sleeves 14, 140 which face each other and by means of screws which are axis parallel to the tool spindle are exchangeably connected to the sleeve 14, 140, said screws engaging said flanges 16, 160. The sleeves 14, 140 have their cylindrical inner circumferential surfaces slideably arranged on the cylindrical outer circumferential surface of the tool spindle 8. The sleeves 14, 140 are relative to said tool spindle 8 secured in the direction of rotation substantially in a play-free manner by groove blocks or shaft wedges 17. At the free end, the tool spindle 8 has a protruding flange 19 forming an abutment flange for the pertaining sleeve 14, 140 whereas at the other end for the pertaining sleeve 14 there is provided a disengageable spring ring 18 forming an abutment flange. The tool spindle 8 has its rear end provided with a bore for engagement by the working or main spindle 20 of a machine tool against which it can be clamped by means of a clamping screw 21 located in its shaft and thereby secured against rotation. On those outer sides of individual tools 11 and 12 which face away from each other, each sleeve 14, 140 has approximately in the central portion of the length of the pertaining section an annular flange 22, 220 which at both end faces is embraced by an axial bearing 23, 230 of the adjusting device 9. Each axial bearing 23, 230 has two race rings 24, 240 respectively engaging one end face. The race rings 24, 240 are journaled on balls and the axes of said race rings intersect the axis 10 of the tool spindle 8 at a right angle and are mounted on two adjacent plates 25, 250 which are braced against each other. The two plates 25, 250 braced against each other have aligned bores 26, 260 by means of which they are respectively axially displaceably but disengageably arranged on a bearing sleeve 27, 28. The two bearing sleeves 27, 28 are by means of cylindrical bores axially displaceably mounted on a cylindrical supporting sleeve 29. In the supporting sleeve 29 along the axis of which there is located an adjusting spindle 30 which through the intervention of a conical body 31 located along the axis 32 of the supporting sleeve 29 and through radial pins 33 guided in bores of the supporting sleeve 29 and engaging said conical body 31 acts upon those end faces of the bearing sleeve 27, 28 which face each other. The two bearing sleeves 27, 28 are spring urged toward each other by spring packets 34, 340 in the supporting sleeve 29 and are thus spring loaded against the radial pins 33. When the spindle 30, for instance by handle 35 arranged at one end, a driving motor connected thereto, or the like are turned in one direction of rotation, the radial pins 33 are pressed radially outwardly so that the two bearing sleeves 27, 28 are pressed apart against the thrust of springs 34, 340. As a result thereof, the individual tools 11, 12 are carried along and are correspondingly moved away from each other. This may be effected without difficulties by the described design with the tool 5, 6 rotating so that this operation can be effected during a machining operation. If the spindle 30 is turned in the opposite direction, the individual tools 11, 12 are moved toward each other by the thrust of springs 34, 340.

The supporting sleeve 29 is connected to a plate shaped support 36 which comprises a connecting flange 37 which is located along the axis of the tool spindle 8 and serves for an exchangeable or disengageably connection to the bearing eye of the machine tool. The arrangement is such that the support 36 is located adjacent to the rear end face of the tool spindle 8 and that the working spindle 20 is passed through the flange 37.

On that side of the axis 32 which faces away from the tool spindle 8, the plates 25, 250 as well as the support 36 have bores of the same diameter for a plug pin 38 which when in working position engages all bores and thereby arrests the plates 25, 250 relative to the support 36. When the pin 38 is pulled out of the bore of the support 36, the plates 25, 250 can be pivoted on the bearing sleeves 27, 28 or the bearing sleeves 27, 28 can be pivoted on the supporting sleeve 29 about the axis 32 for instance by 90° in such a way that the axial bearings 23, 230 which engage the flanges 22, 220 can be brought out of engagement with the flanges 22, 220 and that the tool spindle 8 can independently of the adjusting device 9 be disengaged from the main spindle 20 for instance for purposes of exchanging a tool.

As will be seen from FIG. 1, in the feeding direction indicated by arrow 4, and in front of the respective tool 5, 6 there is provided an optical, mechanical or other feeling or scanning device 39 for feeling or scanning the workpiece edge 40 to be machined, said feeling device 39 providing a governor or pulse emitter 41 with measured actual values. This governor 41 compares the rated values with the actual values and if necessary initiates an adjustment of the individual tools 11, 12. The rated value condition for the governor 41 associated with the tool 5 is expediently based on the assumption that the break-outs caused by the tool 5 are less than the cutting depth of the tool 6. The governor 41 associated with the tool 6 expediently compares the size of the break-outs with a rated value and compares the number of the break-outs per length unit with a further rated value.

The axial adjusting movement of the individual tools 11, 12 may in addition by the thread also be brought about by another transmission, by pneumatically or hydraulically actuated adjusting system, wedge system or similar arrangements.

Figure 4:
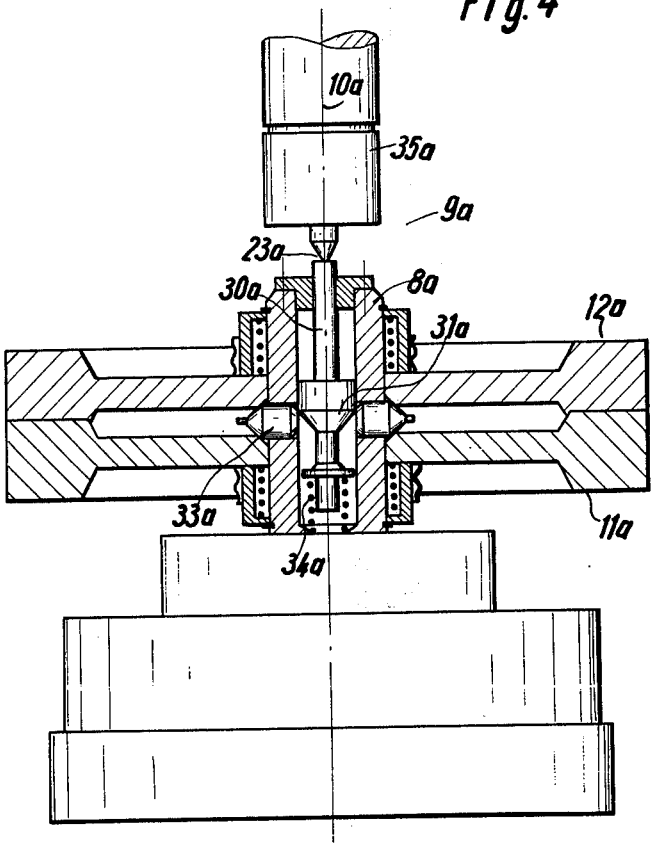
FIG. 4 is a further embodiment of the present invention in an illustration similar to that of FIG. 2.

With the embodiment illustrated in FIG. 4, the tool spindle 8 is formed directly by the working spindle of the machine tool. The adjusting device **9*a* is substantially completely located along the axis 10*a* of the tool spindle 8*a*. The two individual tools 11*a*, 12*a* which are spring urged toward each other are by means of radial pins 33*a* guided in bores of the spindle 8*a* and are in engagement with a conical body 31*a* which is journaled in both of the tool spindles 8*a* and is axially displaceable against the thrust of a spring 34*a*. The conical body 31*a* is connected to an adjusting bar 30*a* which protrudes from the free end of the tool spindle 8*a*. The end face of said adjusting bar 30*a* is along the axis 10*a*, engaged by the connecting rod of an adjusting cylinder 35 through an axial bearing 23*a* so that the individual tools 11*a*, 12*a* during the operation of the tool spindle 8*a*** and thus during the machining operation can be adjusted in the described manner.

It is, of course, to be understood that the present invention is, by no means, limited to the specific showing in the drawings but also comprises any modifications within the scope of the appended claims.

We claim:

1. An apparatus for machining the edges of panels, especially the edges of wood-like material having at least one layer of synthetic material glued thereon; rotary tool means having peripheral cutting means thereon for cutting engagement with the edge of a panel, a spindle for rotatably supporting said rotary tool means, slide means reciprocable on the spindle and connected to the tool means, and adjustable means engaging said slide means and operable to adjust said slide means axially on said spindle during rotation of said tool means, said adjustable means also being operable to retain said slide means in adjusted positions on said spindle, said tool means comprising a pair of tools in side by side relation, said slide means comprising a sleeve for each tool, each sleeve being fixed to the respective tool and reciprocable on the said spindle, said sleeves being adjustable on said spindle in respectively opposite directions and the said cutting means on each said tool overlapping those on the other tool when the tools are viewed in the circumferential direction.

2. An apparatus for machining the edges of panels, especially the edges of panels of wood-like material having at least one layer of synthetic material glued thereon; rotary tool means having peripheral cutting means thereon for cutting engagement with the edge of a panel, a spindle for rotatably supporting said rotary tool means, slide means reciprocable on the spindle and connected to the tool means, and adjustable means engaging said slide means and operable to adjust said slide means axially on said spindle during rotation of said tool means, said adjustable means also being operable to retain said slide means in adjusted positions on said spindle, said adjusting means being contained within said spindle.

3. An apparatus according to claim 1 in which said slide means comprises sleeve means on said spindle, said sleeve means closely fitting on said spindle.

4. An apparatus according to claim 1 in which said adjusting device comprises a support in radially spaced relation to said spindle and defining a pivot axis parallel to the axis of the spindle, a radial flange on each sleeve, an adjustable member reciprocable on said support for each sleeve and having roller means engaging opposite axial sides of the said flange on the respective sleeve, and adjusting means for adjusting said adjustable members axially on said support.

5. An apparatus according to claim 4 in which each adjustable member is pivotal on said support to disengage the roller means thereof from the respective said flange.

6. An apparatus according to claim 4 in which said support is spaced from said spindle in about the direction in which panels to be cut are fed past the tools.

7. An apparatus according to claim 1 in which said adjusting means moves said adjustable members positively in one direction while resilient means are provided for moving said adjustable members in the other direction.

8. An apparatus according to claim 1 in which said adjusting means is operable when adjusted to cause equal movement of said sleeves in respectively opposite directions.

9. An apparatus according to claim 1 which includes a feeler engaging the edge of a panel to be machined in advance of said tool means, a pulse emitter actuated by said feeler, and means for adjusting said tool means in conformity with pulses emitted by said emitter.

* * * * *